US008047866B2

(12) United States Patent
Poe

(10) Patent No.: US 8,047,866 B2
(45) Date of Patent: Nov. 1, 2011

(54) TRANSMISSION CABLE THAT ELIMINATES NEGATIVE MAGNETICALLY INDUCTIVE IMPEDANCE

(75) Inventor: Jen-Chun Poe, Taipei (TW)

(73) Assignee: Top 1 Green Development Co., Ltd., Taipei (TW)

( * ) Notice: Subject to any disclaimer, the term of this patent is extended or adjusted under 35 U.S.C. 154(b) by 0 days.

(21) Appl. No.: 12/899,549

(22) Filed: Oct. 7, 2010

(65) Prior Publication Data

US 2011/0117771 A1 May 19, 2011

(30) Foreign Application Priority Data

Nov. 16, 2009 (TW) ..... 98221230 U

(51) Int. Cl.
*H01R 11/00* (2006.01)

(52) U.S. Cl. ..... 439/502

(58) Field of Classification Search ..... 439/502, 439/505, 932, 128, 125, 127, 215, 211, 216
See application file for complete search history.

(56) References Cited

U.S. PATENT DOCUMENTS

| | | | | | |
|---|---|---|---|---|---|
| 4,327,702 | A * | 5/1982 | Imai et al. | ..... | 123/620 |
| 5,105,054 | A * | 4/1992 | Kirma | ..... | 174/2 |
| 5,171,159 | A * | 12/1992 | Byrne | ..... | 439/215 |
| 5,267,869 | A * | 12/1993 | Nadasky et al. | ..... | 439/125 |
| 5,679,023 | A * | 10/1997 | Anderson et al. | ..... | 439/502 |
| 6,083,053 | A * | 7/2000 | Anderson et al. | ..... | 439/687 |
| 6,717,412 | B1 * | 4/2004 | Moritz et al. | ..... | 324/380 |
| 7,021,961 | B1 * | 4/2006 | Soderholm | ..... | 439/505 |
| 7,518,852 | B2 * | 4/2009 | Kondas | ..... | 361/622 |
| 7,574,878 | B2 * | 8/2009 | Schroeder | ..... | 68/12.19 |
| 2010/0307467 | A1 * | 12/2010 | Lerchenmueller | ..... | 123/634 |

* cited by examiner

*Primary Examiner* — Jean Duverne
(74) *Attorney, Agent, or Firm* — Leong C. Lei

(57) ABSTRACT

A transmission cable assembly is connected between an ignition coil and a spark plug to transmit a high voltage generated by the ignition coil to the spark plug for ignition of a fuel-air mixture. The transmission cable assembly includes a transmission cable and a grounding unit. The transmission cable includes a high-voltage wire for transmission of high voltage and an insulation jacket wrapped around an outside surface of the high-voltage wire. The grounding unit is made of an electrically conductive substance and includes a grounding layer and multiple grounding wires. The grounding layer completely covers and tightly engages the insulation jacket. The grounding wires each have an end connected to an inside surface of the grounding layer.

4 Claims, 3 Drawing Sheets

TRANSMISSION CABLE THAT ELIMINATES NEGATIVE MAGNETICALLY INDUCTIVE IMPEDANCE

TECHNICAL FIELD OF THE INVENTION

The present invention generally relates to a power transmission cable, and more particularly to a transmission cable that eliminates negative magnetically inductive impedance.

DESCRIPTION OF THE PRIOR ART

Referring to FIG. 1, a conventional power transmission cable 900 is shown. The transmission cable 900 has an end forming a connector 910 for connection with an ignition coil (not shown) and an opposite end forming a connector 920 for connection with a spark plug (not shown). The ignition coil generates a high voltage (which is a positive voltage of 8,000-25,000V) transmitted through the transmission cable 900 to the spark plug. The spark plug, when receiving the high voltage, generates a spark that ignites a fuel-air mixture.

However, when the transmission cable 900 transmits the high voltage, an inductive impedance (also referred to as thermal impedance) corresponding to the high voltage and showing a negative voltage of around 18,000-25,000V is induced on an outer surface layer 930 of the cable. Consequently, the voltage finally transmitted to the spark plug is lowered to a level of around 3,000-4,000V, which is lower than a critical voltage (7,000V) for ignition caused by the spark plug. A conventional solution to such a problem is to increase the high voltage generated by the ignition coil to a level of 100,000V, which after being consumed by the inductive impedance can supply a voltage that is still beyond the critic voltage of ignition. However, this solution consumes additional electrical power.

SUMMARY OF THE INVENTION

Thus, an objective of the present invention is to provide a transmission cable that reduces or even eliminates negative inductive impedance.

According to the present invention, a transmission cable assembly that eliminates negative magnetically inductive impedance is provided for connection between an ignition coil and a spark plug to transmit a high voltage generated by the ignition coil to the spark plug. The transmission cable assembly comprises a transmission cable and a grounding unit.

The transmission cable comprises a high-voltage wire for transmission of high voltage and an insulation jacket wrapped around an outside surface of the high-voltage wire. The grounding unit is made of an electrically conductive substance and comprises a grounding layer and a grounding wire. The grounding layer completely covers and tightly engages a surface of the insulation jacket. The grounding wire has an end connected to an inside surface of the grounding layer.

Preferably, the transmission cable assembly further comprises a first connector and a second connector respectively coupled to opposite ends of the transmission cable. The first connector is for connection with the ignition coil and the second connector is for connection with the spark plug. The grounding layer is arranged to partly or completely enclose and tightly engage surfaces of the first connector and the second connector.

Further, the grounding layer comprises a metal tape that is self-adhesive and shows electrical conductivity and the grounding wire comprises multiple metal wires.

The effectiveness of the present invention is elimination of the negative magnetically inductive impedance induced during the transmission of a high voltage through the transmission cable in order to allow an ignition coil to generate a voltage lower than a conventional device for induction of an electrical current that is greater than that of the conventional device, whereby wear of the spark plug is alleviated and thus the lifespan of the spark plug is extended and further sparks can be generated more easily to facilitate complete combustion.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
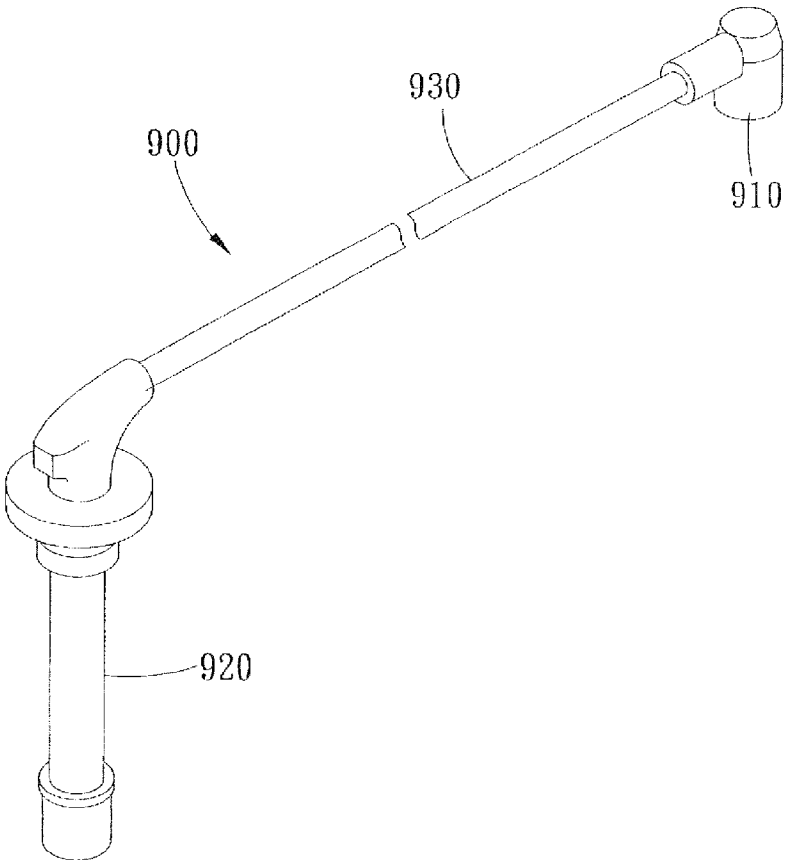
FIG.1 PRIOR ART
FIG. 1 is a perspective view showing a conventional transmission cable for connection between an ignition coil and a spark plug.
Figure 2:
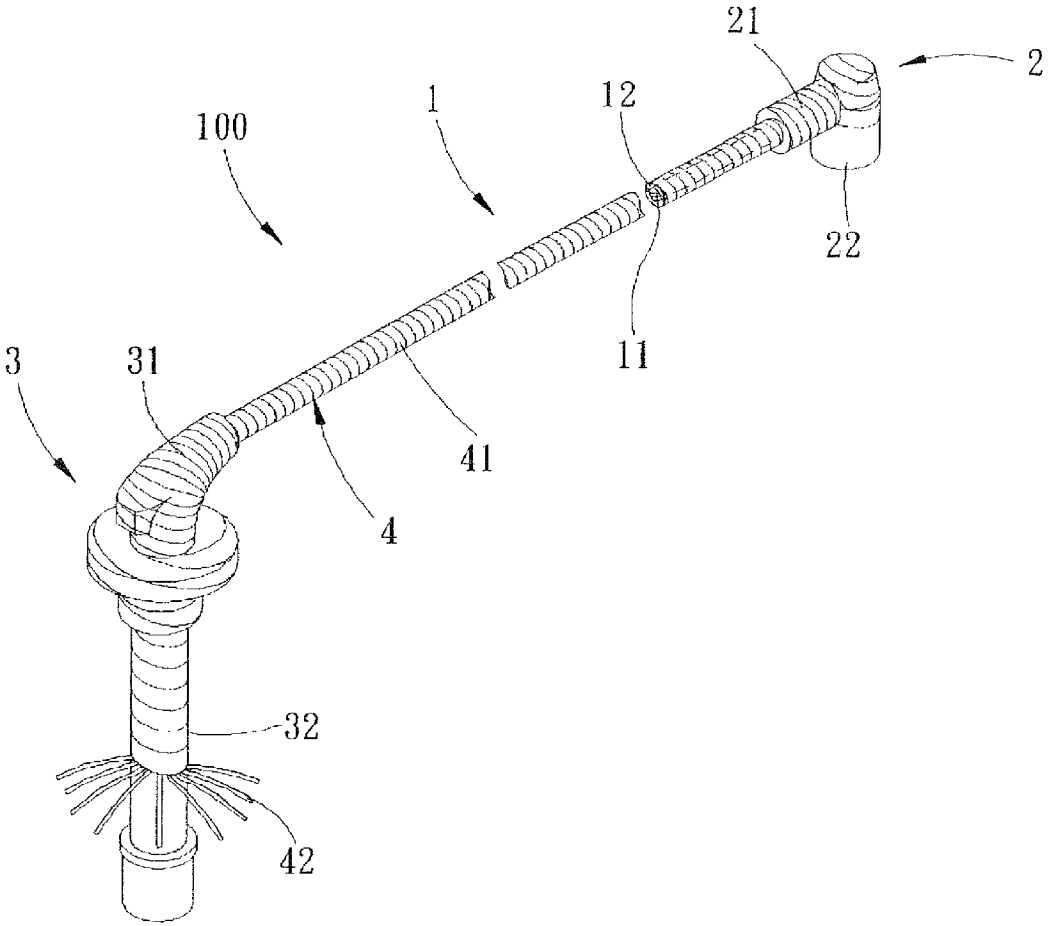
FIG. 2 is a perspective view showing a transmission cable assembly according to the present invention that eliminates negative magnetically inductive impedance, wherein a grounding layer is partly wrapped around a first connector and a second connector.
Figure 3:
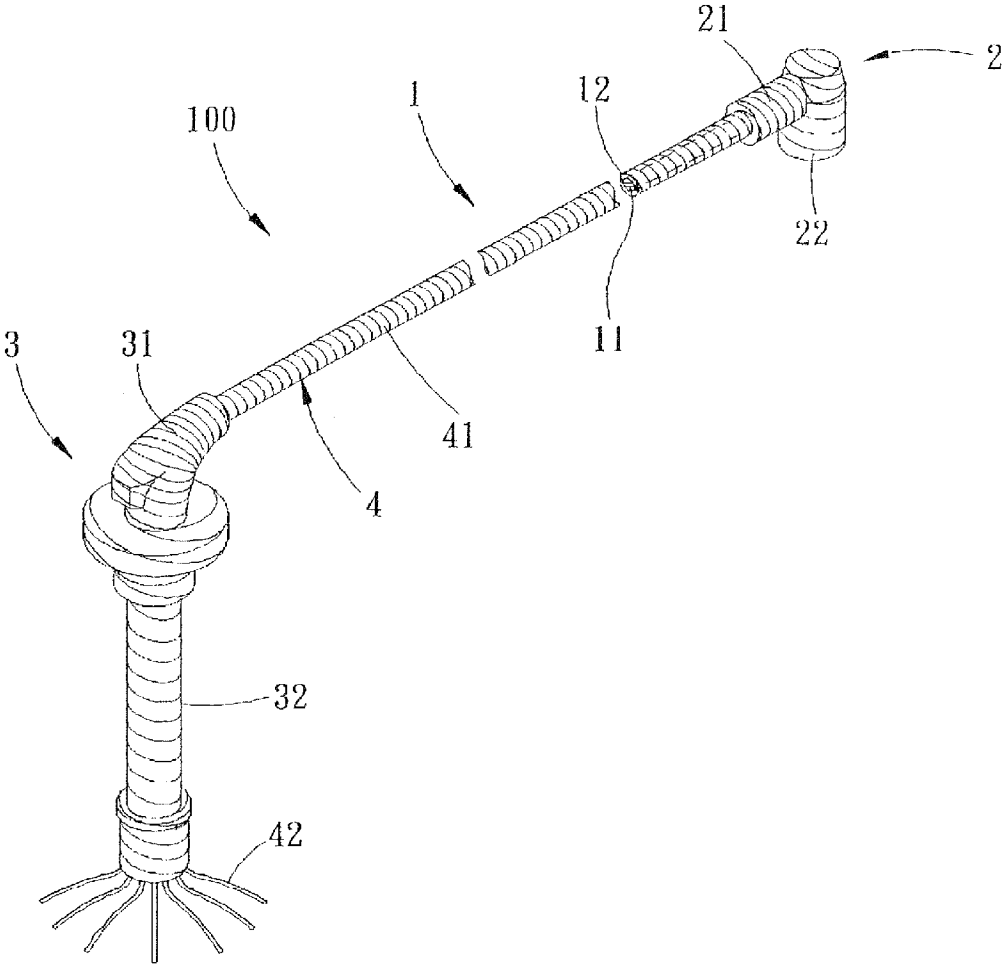
FIG. 3 is a perspective view showing a transmission cable assembly according to the present invention that eliminates negative magnetically inductive impedance, wherein a grounding layer is completely wrapped around a first connector and a second connector.

Referring to FIGS. 2 and 3, a transmission cable assembly constructed in accordance with a preferred embodiment for eliminating negative magnetically inductive impedance, generally designated at 100, is shown. The transmission cable assembly 100 is used in an automobile (not shown) to be connected between an ignition coil and a spark plug (both not shown) for transmission of a high voltage generated by the ignition coil to the spark plug, and helping eliminating negative magnetically inductive impedance (also referred to as thermal impedance) during the process of transmission, so as to generate an ignition spark that is of a voltage lower than that of a conventional device and of a current greater than that of the conventional device. The transmission cable assembly 100 comprises a transmission cable 1, a first connector 2 and a second connector 3 respectively mounted to opposite ends of the transmission cable 1, and a grounding unit 4.

The transmission cable 1 comprises a high-voltage wire 11 for transmission of the high voltage and an insulation jacket 12 enclosing an outer surface of the high-voltage wire 11. Generally, the high voltage transmitted by the transmission cable 1 is a positive voltage of or greater than 8,000-25,000 volts. In the embodiment illustrated, a positive 25,000V voltage is taken as an example for illustration. The insulation jacket 12 is made of an insulation substance.

The first connector 2 is for connection with the ignition coil and comprises a first cap 21 coupled to an end of the transmission cable 1 and a first fitting sleeve 22 extending from an end of the first cap 21 that is opposite to the transmission cable 1 for connection with the ignition coil.

The second connector 3 is for connection with the spark plug and comprises a second cap 31 coupled to an opposite end of the transmission cable 1 and a second fitting sleeve 32 extending from an end of the second cap 31 that is opposite to the transmission cable 1 for connection with the spark plug.

The grounding unit 4 is made of an electrically conductive substance and comprises a grounding layer 41 and a grounding wire 42. The grounding layer 41 comprises a metallic tape that is self-adhesive and shows electrical conductivity and is wrapped in such a way to completely cover the insulation jacket 12 and partly enclose surfaces of the first connector 2 and the second connector 3 (see FIG. 2). Alternatively and preferably, the grounding layer 41 is wrapped to completely cover the insulation jacket 12, and also completely enclose the surfaces of the first connector 2 and the second connector 3 (see FIG. 3). The grounding wire 42 comprises a plurality of metal wires, each having an end connected to an inside surface of the grounding layer 41 and an opposite end connected to a grounding site of an automobile (not shown), such as an engine body, in order to set the grounding unit 4 at the same electrical grounding level as the automobile. It is apparent that the materials and configuration of the grounding layer 41 and the grounding wire 42 and the arrangement of the grounding layer 41 wrapping around the insulation jacket 12 are not limited to the embodiment described herein.

Thus, after a high voltage (which is for example a positive voltage of 25,000 volts) is generated by the ignition coil, the high voltage is transmitted through the first connector 2, the transmission cable 1, and the second connector 3 to the spark plug, whereby the spark plug generates a spark at a tip of an electrode thereof for ignition of a fuel-air mixture.

It is noted that at the time when the high voltage transmits through the high-voltage wire 11 of the transmission cable 1, a magnetically inductive impedance showing a negative voltage at a level of for example 25,000 volts is induced on an outer surface of the insulation jacket 12. According to the present invention, with the grounding layer 41 of the grounding unit 4 completely covering the insulation jacket 12, and partly or completely enclosing the surfaces of the first connector 2 and the second connector 3, during the process when the high voltage is transmitted through the transmission cable assembly 100 to the spark plug, the negative magnetically inductive impedance will be conducted through the grounding layer 41 and the grounding wire 42 of the grounding unit 4 to the engine body and automobile (for grounding), whereby the impedance is lower to zero (or close to zero). As a result, the high voltage transmitted to the spark plug can be effectively maintained at the critic voltage (7000 volts) for the ignition of the spark plug. Namely, the electrical current flowing through the high-voltage wire 11 is kept at a maximum level of current. In other words, since the negative magnetically inductive impedance induced by the transmission cable 1 is significantly lowered, the high voltage generated by the ignition coil can be lower than that used in the prior art devices (meaning less than 8,000 volts), whereby wear of the spark plug can be reduced and lifespan is extended.

Further, the metal tape used to make the grounding layer 41 is of such a thickness that after the second connector 3 is enclosed by the metal tape, the second connector 3 can still be received in the space at the site where the spark plug is mounted, namely above an engine cylinder of automobile (not shown). Thus, the grounding unit 4 according to the embodiment of the present invention does not impose any negative influence on the connection and assembling of the transmission cable assembly 100.

In summary, the transmission cable assembly 100 according to the present invention that eliminates negative magnetically inductive impedance comprises a grounding unit 4 that completely covers and tightly engages an outer surface of the transmission cable 1 and partly or completely encloses and tightly engage surfaces of the first connector 2 and the second connector 3 in order to conduct negative magnetically inductive impedance that is generated due to the high voltage transmitted through the transmission cable 1 to the ground and thus lowering the impedance to zero (or close to zero). As a result, the required high voltage supplied by the ignition coil can be lowered to a level of around positive 8,000 volts or even lower, which is sufficient to cause a situation for effectively inducing spark in the spark plug with a voltage lower than the maximum level required in the conventional devices and a current greater than that of the conventional devices. Consequently, each ignition is made as powerful as the first time ignition when a new transmission cable 1 and a new spark plug are just installed.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A transmission cable assembly comprising:

a transmission cable having a high-voltage wire and an insulation jacket enclosing an outer surface of said high-voltage wire;

a first connector having a first cap coupled to an end of said transmission cable and a first fitting sleeve extending from an end of said first cap;

a second connector having a second cap coupled to an opposite end of said transmission cable and a second fitting sleeve extending from an end of said second cap; and a grounding unit made of an electrically conductive substance and having a grounding layer and a grounding wire, said grounding layer having a metallic tape that shows electrical conductivity and wrapped to completely cover said insulation jacket and partly enclose surfaces of said first and second connectors;

whereby negative magnetically inductive impedance induced during transmission of a high voltage through said transmission cable will be conducted through said grounding layer and said grounding wire of said grounding unit to an engine body thereby reducing said impedance.

2. The transmission cable assembly as claimed in claim 1, wherein said metal said metallic tape is self-adhesive.

3. A transmission cable assembly comprising:

a transmission cable having a high-voltage wire and an insulation jacket enclosing an outer surface of said high-voltage wire;

a first connector having a first cap coupled to an end of said transmission cable and a first fitting sleeve extending from an end of said first cap;

a second connector having a second cap coupled to an opposite end of said transmission cable and a second fitting sleeve extending from an end of said second cap; and a grounding unit made of an electrically conductive substance and having a grounding layer and a grounding wire, said grounding layer having a metallic tape that shows electrical conductivity and wrapped to completely cover said insulation jacket and completely enclose surfaces of said first and second connectors;

whereby negative magnetically inductive impedance induced during transmission of a high voltage through said transmission cable will be conducted through said grounding layer and said grounding wire of said grounding unit to an engine body thereby reducing said impedance.

4. The transmission cable assembly as claimed in claim 3, wherein said metal said metallic tape is self-adhesive.

* * * * *